US006061924A

United States Patent [19]

Bolton et al.

[11] Patent Number: 6,061,924

[45] Date of Patent: May 16, 2000

[54] BATCH SLUDGE DEHYDRATOR

[75] Inventors: Danny R. Bolton, Brownwood; David L. Bigham, Novice, both of Tex.

[73] Assignee: Rubicon Development Co. L.L.C., New Orleans, La.

[21] Appl. No.: 08/828,436

[22] Filed: Mar. 28, 1997

[51] Int. Cl.[7] ..... F26B 11/14

[52] U.S. Cl. ..... 34/134; 34/136; 34/182; 432/108; 432/114; 366/312; 366/319; 165/92

[58] Field of Search ..... 34/135, 136, 137, 34/179, 182, 183, 185, 60, 134; 432/103, 108, 112, 114; 366/309, 310, 311, 312, 313, 315, 318, 319; 165/89, 90, 91, 92

[56] References Cited

U.S. PATENT DOCUMENTS

| | | | |
|---|---|---|---|
| 1,334,495 | 3/1920 | Jackson | 34/183 |
| 1,792,769 | 2/1931 | Schimdt et al. | 34/281 |
| 3,777,810 | 12/1973 | Phillips | 165/92 |
| 3,808,701 | 5/1974 | Bachmann | 34/179 |
| 4,205,458 | 6/1980 | Austin | 34/134 |
| 4,608,766 | 9/1986 | Kawai et al. | 34/578 |
| 4,711,041 | 12/1987 | Ullum | 34/179 |
| 4,712,312 | 12/1987 | Christodoulou | 34/57 D |
| 4,742,622 | 5/1988 | Thompson | 34/12 |
| 4,824,257 | 4/1989 | List et al. | 366/99 |
| 4,941,132 | 7/1990 | Horn et al. | 366/278 |
| 4,982,514 | 1/1991 | Ullum | 34/183 |
| 5,263,267 | 11/1993 | Buttner et al. | 34/519 |
| 5,299,865 | 4/1994 | Presnell | 366/300 |
| 5,321,900 | 6/1994 | Meyer | 34/180 |
| 5,531,034 | 7/1996 | Mentz | 34/179 |
| 5,566,469 | 10/1996 | Bolton et al. | 34/135 |

*Primary Examiner*—Pamela A. Wilson
*Attorney, Agent, or Firm*—Daniel V. Thompson

[57] ABSTRACT

A dehydrating apparatus includes a chamber for receiving wet material to be dehydrated. A rotatably-mounted agitator is provided with the chamber. The agitator is adapted to agitate material in the chamber when the agitator rotates in a first direction and convey the material out of the chamber when the agitator rotates in the other, second direction.

5 Claims, 4 Drawing Sheets

BATCH SLUDGE DEHYDRATOR

TECHNICAL FIELD

This invention relates sludge dehydration, more particularly to a sludge dehydrator that operates in a batch mode.

BACKGROUND ART

The disposal of waste sludge is of increasing concern due to ever tighter environmental regulations. One general type of solution for dealing with such waste is the dehydrator disclosed in our U.S. Pat. No. 5,566,469. While this dehydrator has been effective and economical for its designed purpose, there has been substantial room for improvement with regard to efficiency and cost, as well as the through capacity of the device.

SUMMARY OF THE INVENTION

The sludge dehydrator of the present invention incorporates a system using indirect heat and a batch mode to obtain substantially improved performance in sludge dehydration.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Referring initially to FIGS. 1–4, where like numerals indicate like and corresponding elements, a dehydrating apparatus 10 includes a chamber 12 for receiving material to be dehydrated in an inner cavity 14 with material to be dehydrated. Chamber 12 is cylindrical about a horizontal, longitudinal, central axis 16.

Figure 3:
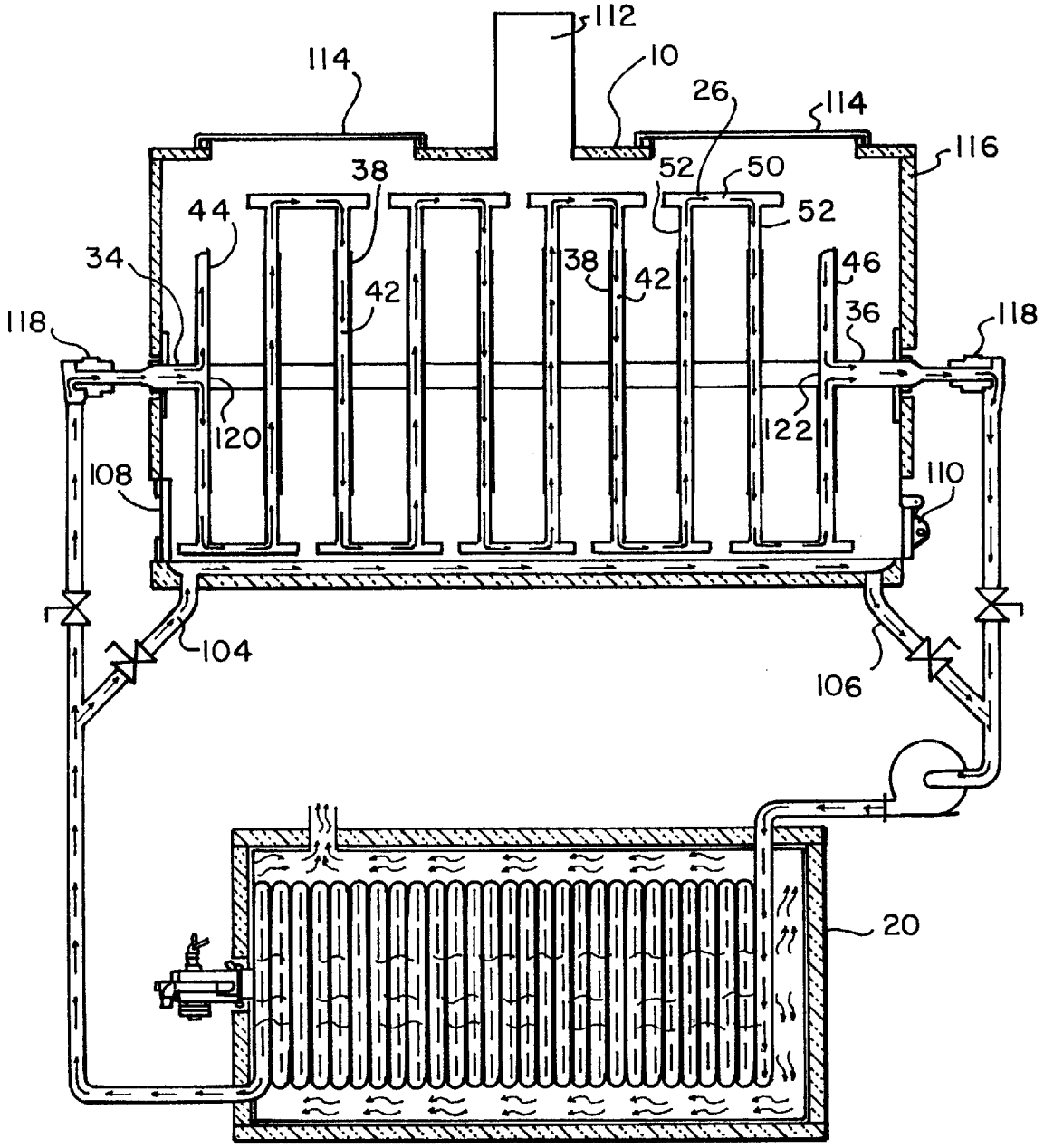
FIG. 3 is a schematic view illustrating the flow of heated oil through the apparatus.
Figure 4:
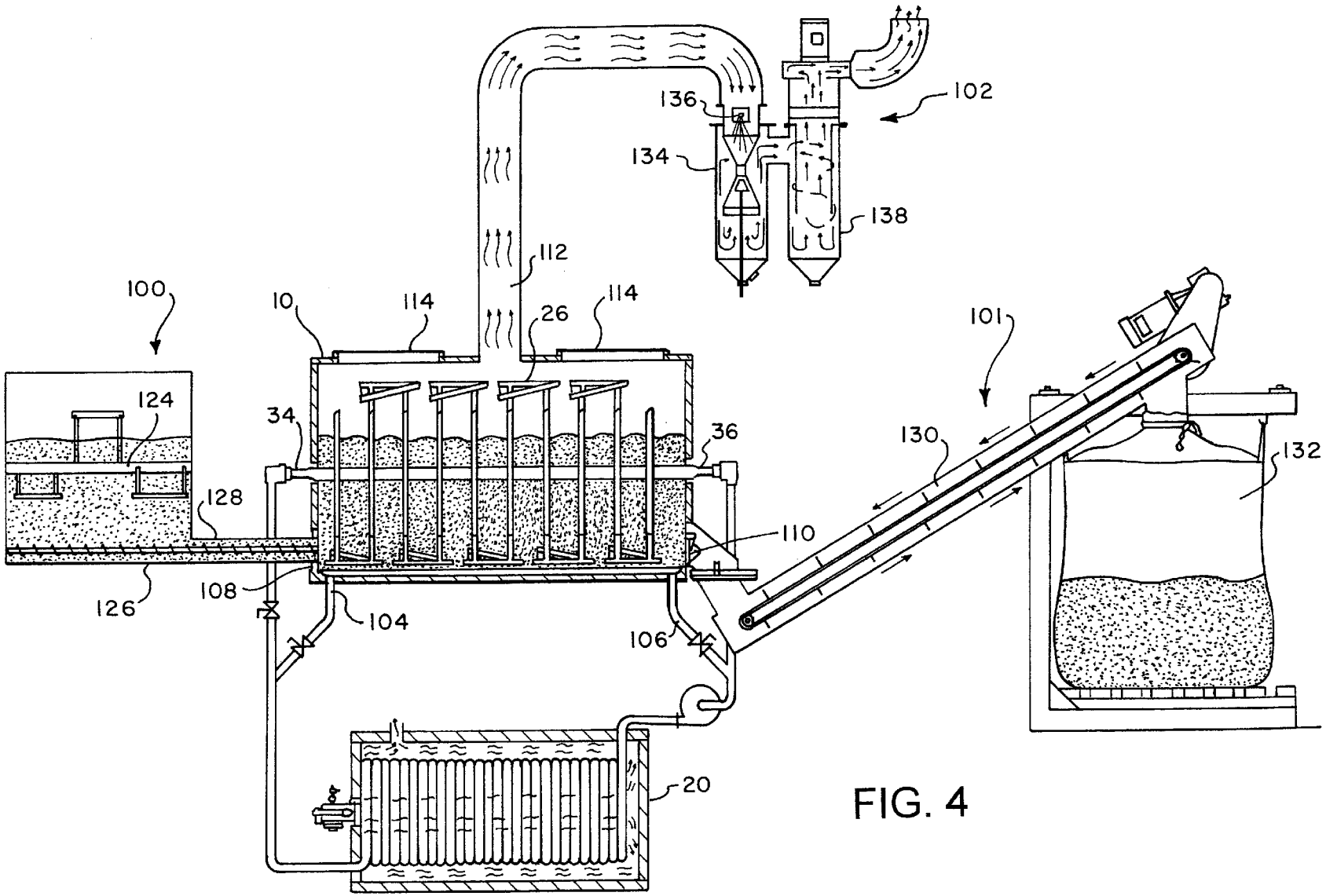
FIG. 4 is a schematic view illustrating the system of the present invention in operation.

Chamber 12 has a heating annulus 18 adapted and arranged to receive heated thermal fluid from a thermal fluid heater 20 (FIGS. 3, 4). Heating annulus 18 is formed by inner and outer chamber walls 22, 24. Outer chamber wall 24 is insulated, and the inner chamber wall 22 is adapted to heat, wet material in the inner cavity 14 by conduction through the inner chamber wall 22.

Figure 1:
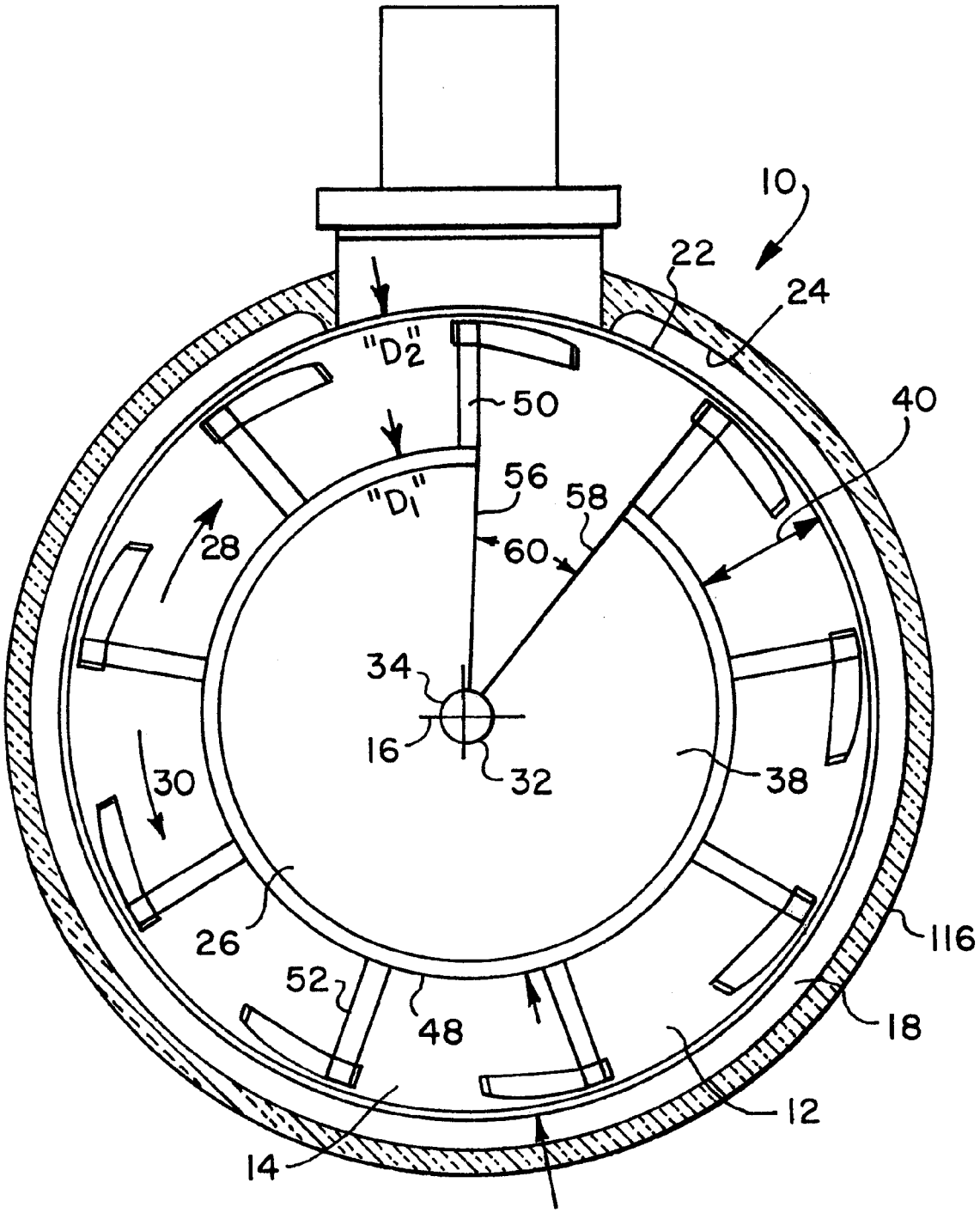
FIG. 1 is a partially broken-away end view of dehydrating apparatus constructed in accordance with the present invention.
Figure 2:
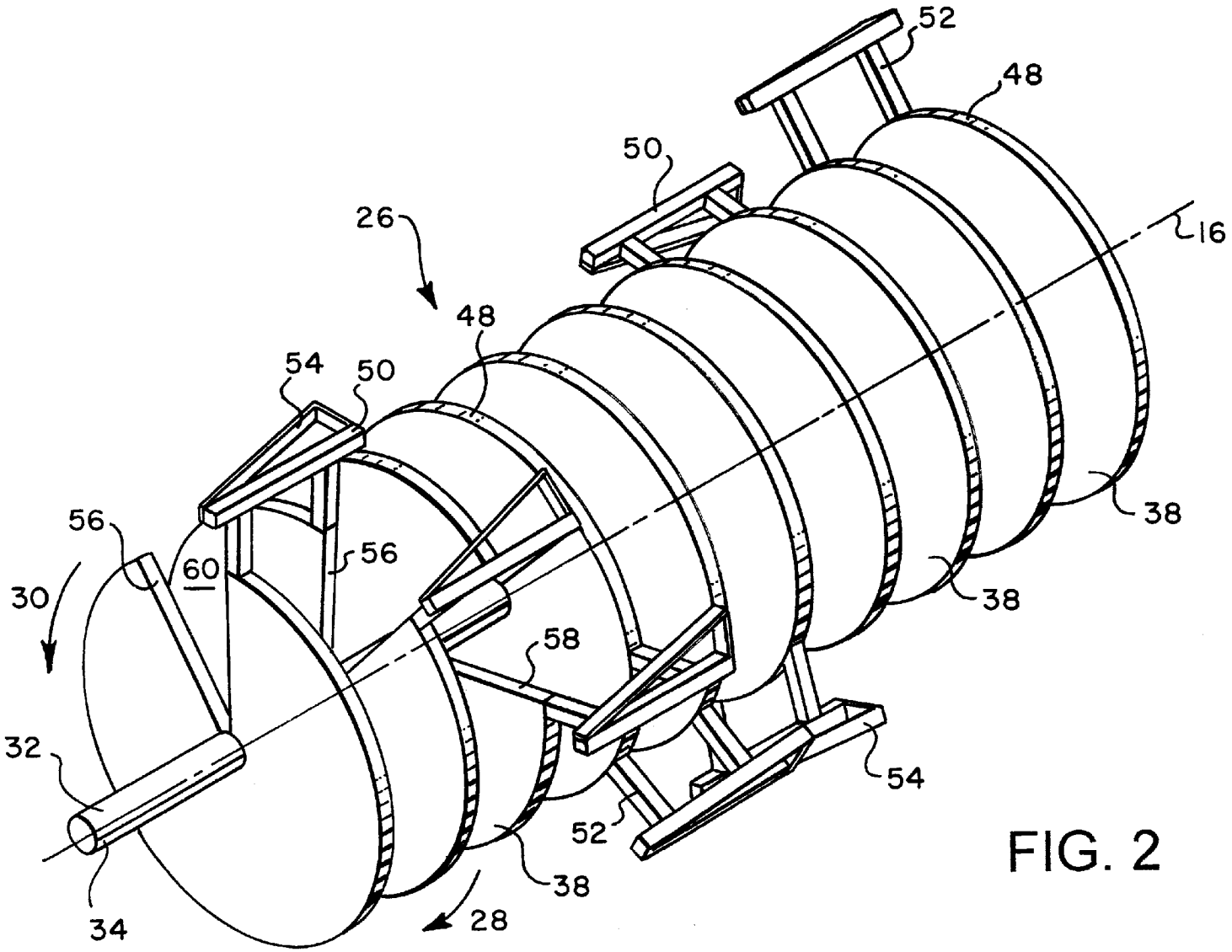
FIG. 2 is a perspective view of an agitator useful with the invention.

A rotatably-mounted agitator 26 is adapted to agitate material in the inner cavity 14 when the agitator 26 rotates in a first direction and convey the material out of the inner cavity 14 when the agitator rotates in the other, second direction. In FIGS. 1 and 2, the first direction is illustrated by arrow 28, and the other, second direction is illustrated by arrow 30.

The agitator 26 is adapted and arranged to receive heated thermal fluid from the thermal fluid heater 20 to heat the agitator 26 and thereby heat the wet material in the inner cavity 14 by conduction.

The agitator 26 is mounted for rotation about the central axis 16 of the chamber 12. The agitator 26 includes a tubular shaft 32 along the central axis 16 adapted to receive heated thermal fluid at a first end 34 thereof and return thermal fluid at the other, second end 36 thereof (FIGS. 3, 4).

A plurality of transverse discs 38 are fixed at substantially equally-spaced locations along the shaft 32. The discs have substantially equal dimensions, with disc outer diameter dimensions "$D_1$" begin substantially less than an inner diameter dimension "$D_2$" of the inner cavity 14. Substantial annular gaps 40 between the discs 38 and the inner chamber wall 22 are provided.

As best shown in FIG. 3, the discs 38 are hollow bodies having internal cavities 42. A first disc 44 in closest proximity to the shaft first end 34 is adapted to receive heated thermal fluid from the shaft first end 34. A last disc 46 in closest proximity to the shaft second end 36 is adapted to return heated thermal fluid to the shaft second end 36. Adjacent pairs of discs 38 are connected at their peripheries 48 by hollow wiper tubes 50 extending between radially-extending, hollow, connecting arms 52 to permit the flow of heated fluid from disc to disc along the shaft from the first end 34 to the second end 36. Wiper tubes 50, as best shown in FIG. 1, are in close proximity to the inner chamber wall 22 such that material is wiped and agitated when the agitator is rotated in the first direction. An angled conveyor bar 54 extends at an acute angle from each wiper bar 50 in the direction of the second direction of agitator rotation.

Each disc 38 has radial walls 56, 58 defining open, wedge-shaped sectors 60. The sectors 60 are indexed along the shaft 32, as best shown in FIG. 2. The connecting arms 52 are aligned with the radial walls 56, 58, such that the conveyor bars 54 push dried material through the sectors 60 when the agitator rotates in the second direction.

In operation, as best shown in FIGS. 3 and 4, the invention is an indirectly heated dehydration system used to evaporate moisture from solids. The system consists of the following primary components: dehydration chamber 12; dehydration chamber agitator 26; thermal fluid heater 20 wet material storage/feed hopper 101; dry product discharge conveyor and bag rack 100; and wet particulate scrubber/condenser 102.

Dehydration Chamber 12. The stationary dehydration chamber 12 is comprised of a cylindrical inner chamber 14 with either thermal fluid coils or preferably another cylindrical chamber surrounding it creating an annulus 18 between the two to allow for the passage of a heated thermal fluid. The dehydration chamber 12 has a thermal fluid inlet port 104, a thermal fluid discharge port 106, a material inlet port 108, a material discharge port 110, an exhaust vapor discharge port 112 and doors 114 for access to the internal workings of the machine. The entire combustion chamber is surrounded by an insulation blanket 116.

Agitator 26. The rotating agitator 26 inside of the dehydration chamber is fabricated from a series of hollow discs 38 welded to a common shaft 32. These hollow discs 38 have a 40 degree wedge-shaped sector 60 cut out of them to allow the wet material being dehydrated to level out over the entire length of the chamber and to let the dry material pass between the discs when it is being discharged. The agitator 26 is supported by the shaft 32 extending through bearings mounted at both ends of the dehydration chamber. Thermal fluid rotary unions 118 are located at either end of the shaft 32 to allow the fluid to enter the rotating shaft. All of the discs 38 are connected by wiper tubes 50 which allow for the passage of thermal fluid from one disc 38 to the next. The fluid is pumped into the end of the agitator shaft 32 where a blank steel flange 120 (FIG. 3) is welded inside of the shaft past the first disc 44. A flange 122 is similarly welded inside the last disc 46 on the other end. Holes are cut in the shaft 32 inside of the first disc 44. This allows the fluid to enter the first disc 44, travel from one disc 38 to the next through the wiper tubes 50 and connecting arms 52, and exit the agitator 26 through the shaft 32 at the opposite end. The wiper tubes 50 have a flat face on one side and an angled conveyor bar 54 on the other. The flat face moves into the material when the system is in the dehydration mode and the angled conveyor bar 54 moves into it when the system is in discharge mode.

Wet Material Storage/Feed Hopper 100. The material storage/feed hopper 100 has a rotating wiper mechanism 124 that maintains a constant feed of material to a screw auger 126 positioned in the bottom. The screw auger 126 conveys the material from the hopper 100 to the dehydration chamber 12 through a feed tube 128 attached to the sludge inlet port 108.

Thermal Fluid Heater 20. The gas, or electric, thermal fluid heater 20 heats the fluid that is pumped through the dehydration chamber annulus 18 and agitator discs 38. The thermal fluid system is closed-loop. The fluid existing the dehydrator is pumped back through the heater, re-heated and sent back to the dehydrator.

Dry Product Discharge Bag Rack and Conveyor 101: The dried solids are discharged from the dehydration chamber 12 into a conveyor 130 that transfers the material to a receptacle 132. These receptacles can be bags, dumpsters, silos, rolloff hoppers, etc.

Wet Scrubber/Condenser 102: The vapors from the dehydrator 12 exit the dehydrator through a ducting 134 that has numerous water spray nozzles 136 positioned in it. This water spray helps to cool the gas stream and collect the particulate that is emitted from the dehydrator exhaust port 112 prior to entering the venturi scrubber/cyclone 138 where a higher efficiency scrubbing/cooling effect occur.

PRINCIPALS OF OPERATION

The material to be dried is placed into the material storage/feed hopper. An automatic slide gate is located inside of the dehydration chamber at the opening of the material inlet port which opens when the unit is being filled and closes when the unit is in the dehydration or discharge mode. The hopper will fill the dehydration chamber to the correct level based upon a predetermined time interval. When the dehydration chamber has been filled, the dehydration process begins with agitator rotation in the correct direction and the heated fluid being pumped through the dehydration chamber and agitator. At the beginning of the drying cycle, when the material is at its wettest, the thermal fluid is maintained at a higher temperature. Toward the end of the cycle, when the material is drier, the temperature of the oil is reduced to keep it from reaching the ignition point. This prevents the scorching, or burning of the material. In the dehydration mode, the flat sides of wiper tubes are working toward the material. During this period, the material is agitated, lifted and churned continuously, exposing it to as much of the heated surface area of the agitator tubes, discs and cylinder walls as possible. Once it has been determined that the material is dry, either on a timed cycle or by a temperature sensor, the system will automatically open the material discharge port door and reverse the direction of the agitator so that the angled conveyor bars are working toward the material. With each revolution, the angled conveyor bars move the material toward, and through, the discharge port opening and deposits it in the dry material conveyor. The dry material is sent from the conveyor to a receptacle, or bag. After the dehydrator is emptied, the system automatically closes the discharge port door and refills with wet material to begin the next dehydration cycle. Since the system is sealed, the exhaust from the dehydrator is virtually a pure vapor. The air scrubber/condenser is designed to remove the particulate which may be entrained in the exhaust stream and condense as much of the vapor as possible back to a liquid.

Whereas, the present invention has been described with respect to a specific embodiment thereof, it will be understood that various changes and modifications will be suggested to one skilled in the art, and it is intended to encompass such changes and modifications as fall within the scope of the appended claims.

We claim:

1. A dehydrating apparatus, comprising:

a chamber for receiving wet material to be dehydrated;

a rotatably-mounted agitator within the chamber, the agitator being adapted to agitate material in the chamber when the agitator rotates in a first direction and convey the material out of the chamber when the agitator rotates in a second direction;

with the agitator being adapted and arranged to receive heated thermal fluid from a thermal fluid heater to heat the agitator and thereby heat the wet material in an inner cavity of the chamber by conduction;

with the agitator being mounted for rotation about a central axis of the chamber;

the agitator including a tubular shaft having a first end and a second end along the central axis adapted to receive heated thermal fluid at the first end of the shaft and return thermal fluid at the second end of the shaft;

with a plurality of transverse discs fixed at substantially equally-spaced locations along the shaft; and with the discs being hollow bodies having internal cavities, a first disc of the transverse discs in closest proximity to the first end of the shaft being adapted to receive heated thermal fluid from the first end of the shaft, and a last disc of the transverse discs in closest proximity to the second end of the shaft being adapted to return heated thermal fluid to the second end of the shaft.

2. The apparatus of claim 1 with adjacent pairs of discs being connected at their peripheries by hollow wiper tubes extending between radially-extending, hollow, connecting arms, to permit the flow of heated fluid from the adjacent pairs of discs along the shaft from the first end to the second end, and the wiper tubes being in close proximity to the inner chamber wall such that material is wiped and agitated when the agitator is rotated in the first direction.

3. The apparatus of claim 2 with an angled conveyor bar extending at an acute angle from each of the wiper tubes in the direction of the second direction of agitator rotation.

4. The apparatus of claim 3 with each of the discs having radial walls defining open, wedge-shaped sectors, the sectors being indexed along the shaft, with the connecting arms aligned with the radial walls such that each conveyor bar pushes dried material through the sectors when the agitator rotates in the second direction.

5. A dehydrating apparatus, comprising:

a chamber for receiving in an inner cavity wet material to be dehydrated, the chamber being cylindrical about a horizontal, longitudinal, central axis;

the chamber having a heating annulus formed by an inner chamber wall and outer an chamber wall, with the heating annulus adapted and arranged to receive heated thermal fluid from a thermal fluid heater, with the outer chamber wall being insulated, and the inner chamber wall being adapted to heat the wet material in the inner cavity by conduction through the inner chamber wall;

a rotatably-mounted agitator being adapted to agitate material in the inner cavity when the agitator rotates in a first direction and convey the material out of the inner cavity when the agitator rotates in a second direction;

the agitator being adapted and arranged to receive heated thermal fluid from the thermal fluid heater to heat the agitator and thereby heat the wet material in the inner cavity by conduction;

the agitator being mounted for rotation in a first direction and a second direction about the central axis of the chamber;

the agitator including a tubular shaft having a first end and a second end along the central axis adapted to receive heated thermal fluid at the first end other and return thermal fluid at the other, second end;

a plurality of transverse discs fixed at substantially equally-spaced locations along the shaft;

the discs having substantially equal dimensions, with disc each of the discs having outer diameter dimensions being substantially less than an inner diameter dimension of the inner cavity, such that substantial annular gaps between the discs and the inner chamber wall are provided;

the discs being hollow bodies having internal cavities, a first disc of the plurality of discs in closest proximity to the first end of the shaft being adapted to receive heated thermal fluid from the first end of the shaft, and a last disc of the plurality of discs in closest proximity to the second end of the shaft being adapted to return heated thermal fluid to the second end of the shaft;

adjacent pairs of discs being connected at their peripheries by hollow wiper tubes extending between radially-extending, hollow, connecting arms, to permit the flow of heated fluid from the adjacent pairs of discs along the shaft from the first end to the second end, and the wiper tubes being in close proximity to the inner chamber wall such that material is wiped and agitated when the agitator is rotated in the first direction;

an angled conveyor bar extending at an acute angle from each of the wiper tubes in the direction of the second direction of agitator rotation; and each of the discs having radial walls defining open, wedge-shaped sectors, the sectors being indexed along the shaft, with the connecting arms aligned with the radial walls such that each conveyor bar pushes dried material through the sectors when the agitator rotates in the second direction.

* * * * *